United States Patent [19]

De Garmo

[11] Patent Number: 4,555,196

[45] Date of Patent: Nov. 26, 1985

[54] TANNING WAND

[76] Inventor: Billy B. De Garmo, 121 Jackson St., Weston, W. Va. 26452

[21] Appl. No.: 490,403

[22] Filed: May 2, 1983

[51] Int. Cl.[4] ..... B43M 11/02; B44D 3/28

[52] U.S. Cl. ..... 401/220; 401/205

[58] Field of Search ..... 401/191, 197, 202, 205, 401/207, 208, 218, 219, 220

[56] References Cited

U.S. PATENT DOCUMENTS

| | | | |
|---|---|---|---|
| 2,972,764 | 2/1961 | Linenfelser | 401/197 |
| 3,104,413 | 9/1963 | Nelson | 401/208 |
| 3,560,102 | 2/1971 | Wetzel | 401/218 |
| 3,726,602 | 4/1973 | Rosocha | 401/208 |
| 4,128,350 | 12/1978 | Gamache | 401/208 |
| 4,129,391 | 12/1978 | Gamache | 401/208 |
| 4,342,522 | 8/1982 | Mackles | 401/220 |

*Primary Examiner*—Richard J. Apley
*Assistant Examiner*—Carolyn A. Harrison
*Attorney, Agent, or Firm*—Richard L. Miller

[57] ABSTRACT

A tanning wand for dispensing tanning oil and the like from a container is provided and consists of a housing having a pair of opposite extending end walls, a resilient roller rotatively mounted to the housing between the end walls, a tube having a threaded opening in bottom of the tube that mates with a threaded neck of the container, a T-shaped passage and a plurality of soft bristle brushes for directing the tanning oil through the housing onto the roller along an entire portion of a contact surface thereof, a stop cock for controlling the tanning oil flow through the T-shaped passage of the housing and a guard that snaps on the housing over the roller between the end walls.

6 Claims, 4 Drawing Figures

TANNING WAND

BACKGROUND OF THE INVENTION

The instant invention relates generally to applicators and more specifically it relates to a tanning wand for dispensing tanning oil and the like from a container.

When a person goes sun bathing in the heat of the summer they can take along a container of tanning oil. However when using the container in a conventional manner the hands can become covered with the tanning oil thus causing a situation that may interfere with reading in the sun or engaging in other activities. Tanning oil is often wasted by being put on too heavily with the hands whereby they must be wiped clean wasting the tanning oil.

Numerous applicators have been provided in prior art that are adapted to apply a liquid to a body. For example, U.S. Pat. Nos. 4,128,350 and 4,147,441 are illustrative of such prior art. While these units may be suitable for the particular purpose to which they address, they would not be as suitable for the purposes of the present invention as heretofore described.

SUMMARY OF THE INVENTION

A principal object of the present invention is to provide a tanning wand for dispensing tanning oil and the like from a container that allows an even distribution of the tanning oil on a roller for an even application in hard to reach areas such as the middle of a back of a body.

Another object is to provide a tanning wand for dispensing tanning oil and the like from a container that allows the user to keep hands oil-free.

An additional object is to provide a tanning wand for dispensing tanning oil and the like from a container that makes an even layer of tanning oil on the body thus conserving the tanning oil.

A further object is to provide a tanning wand for dispensing tanning oil and the like from a container that is simple and easy to use.

A still further object is to provide a tanning wand for dispensing tanning oil and the like from a container that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENT

Figure 1:
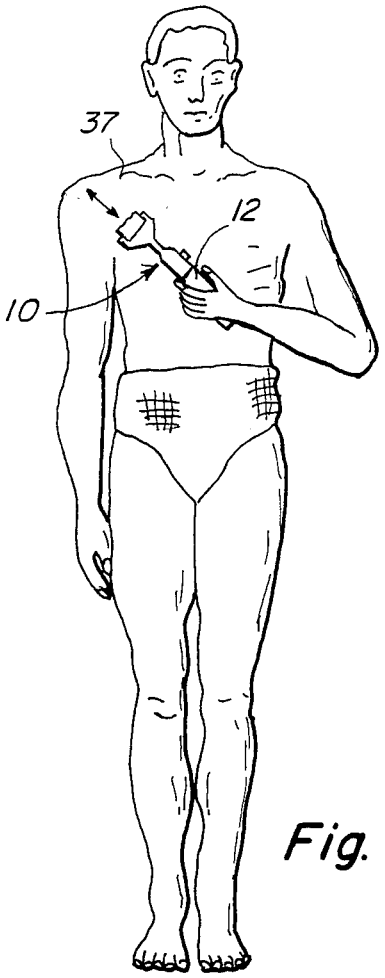
FIG. 1 is a front elevational view showing the invention in use.
Figure 2:
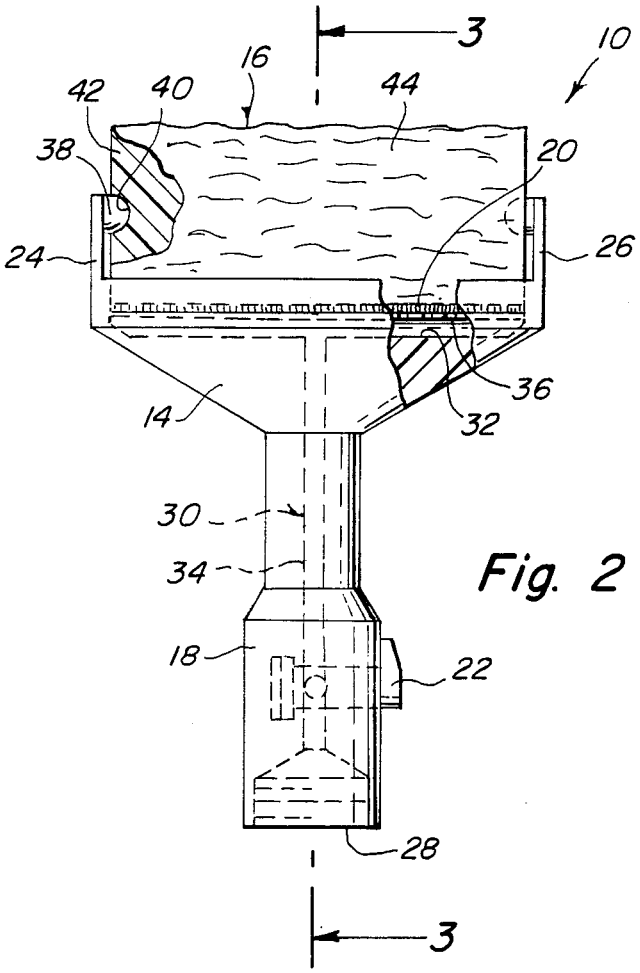
FIG. 2 is a front elevational view of the invention with parts broken away.
Figure 3:
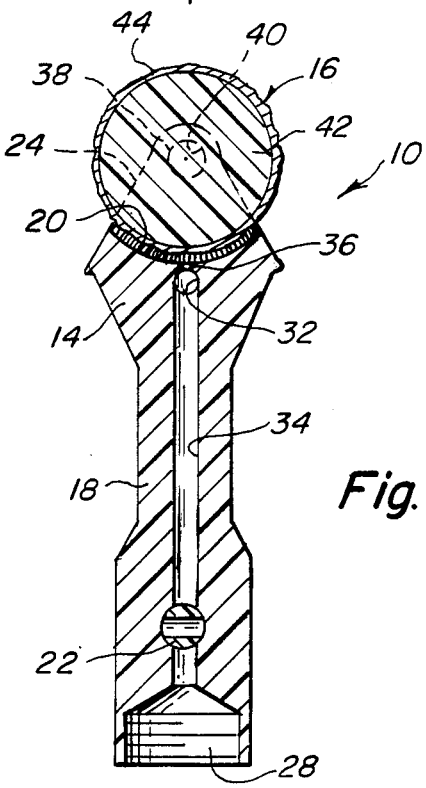
FIG. 3 is a cross sectional view taken on line 3—3 in FIG. 2.

Turning now descriptively to the drawings, in which similar reference characters denote similar elements throughout the several views, FIGS. 1 through 3 illustrates a tanning wand 10 for dispensing tanning oil and the like from a container 12. The tanning wand 10 consists of a housing 14, a resilient roller 16, a tube 18, a plurality of soft bristle brushes 20, and a stop cock 22.

The housing 14 has a pair of opposite extending end walls 24 and 26 so as to act as a support for the resilient roller 16 is rotatively mounted to the housing 14 between the end walls 24 and 26.

The tube 18 has a threaded opening 28 in the bottom of the tube that mates with a threaded neck (not shown) of the container 12 while the top of the tube 18 is affixed to the housing 14.

A T-shaped passage 30 has a horizontal portion 32 and a vertical portion 34. The horizontal portion 32 has a plurality of exit apertures 36 therethrough at top of the housing 14 between the end walls 24 and 26. The vertical portion 34 connects with the threaded opening 28 in the tube 18 for directing the tanning oil through the housing 14 onto the roller 16.

The plurality of soft bristle brushes 20 are mounted along the top of the housing 14 in alignment with the exit apertures 36 of the T-shaped passage 30. The brushes 20 will aid in the even distribution of the tanning oil on the roller 16 while still allowing rotation of the roller in either direction in frictional engagement with a body 37. The wand 10 should be inverted to place the roller 16 lower than the container 12 if the container 12 is not a squeezable type.

Each end wall 24 and 26 has a hemispherical bearing boss 38 while on each end of the roller 16 has an integral hemispherical recess 40 so that the roller 16 can snap onto the housing 14. The roller 14 consists of a relatively rigid drum 42 covered with a thin layer of absorbent material 44.

The stop cock 22 controls the tanning oil flow through the vertical portion 34 of the T-shaped passage in the tube 18 by turning it one way to open while turning it another way to close.

Figure 4:
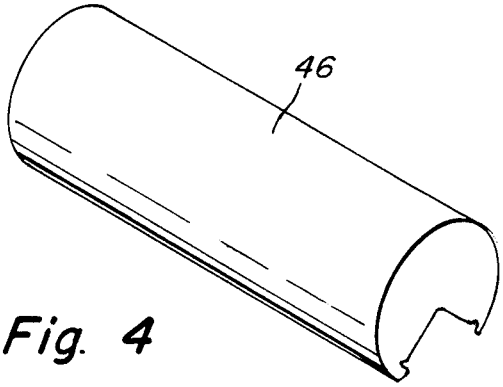
FIG. 4 is a perspective view of a snap on guard.

FIG. 4 shows a guard 46 that snaps on the housing 14 over the roller 16 between end walls 24 and 26 so that the guard 46 will protect the roller 16 from dirt, sand and the like.

The tanning wand 10 may be constructed entirely of molded plastic and could be manufactured very inexpensively.

In operative use the function of the tanning wand 10 is quite simple. It is connected to the tanning oil container as if it were the cap, oil flow is controlled by the stop cock 22. When the stop cock 22 is opened the oil flows through the tube 18 via the T-shaped passage 30 and out of the exit apertures 36 onto the soft bristle brushes which will come in contact with the roller 16. The roller 16 will turn when placed in friction engagement with the user's body 37 so that an even coat of sun tan oil etc. can be spread there upon.

It should be further understood that the container 12 may be of a pliable plastic so that the contents can be squeezed out of this container if so desired into the passage 34, this situation provides positive control of the contents and prevents accidental excessive dispensing of the material.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A tanning wand for dispensing tanning oil and the like from a container which comprises:

(a) a housing having a pair of opposite extending end walls;

(b) a resilient roller rotatively mounted to the housing between the end walls;

(c) means for directing the tanning oil through the housing onto the roller along an entire portion of a contact surface thereof, whereby tanning oil may be evenly spread on a surface by frictional engagement with said roller, wherein the wand is an attachment to the container and the housing includes means for securing the housing to the container, wherein said means for securing the housing to the container is a tube, affixed at its upper end to said housing, having a threaded opening at its lower end which mates with a threaded neck of said container;

(d) a T-shaped passage means for directing the tanning oil through the housing onto the roller having a horizontal portion having a plurality of exit apertures therethrough at top of the housing between the end walls and a vertical portion which connects with the threaded opening in the tube; and (e) a plurality of soft bristle brushes mounted along the top of the housing in alignment with the exit apertures of the horizontal portion of the T-shaped passage so that the soft bristle brushes will aid in the even distribution of the tanning oil on the roller while still allowing rotation of the roller in either direction.

2. A tanning wand as recited in claim 1 wherein the means for rotatively mounting the roller to the housing comprises hemispherical bearing bosses on each end wall and internal hemispherical recesses on each end of the roller so that the roller can snap on and off the housing.

3. A tanning wand as recited in claim 2 wherein the roller comprises a relatively rigid drum covered with a thin layer of absorbent material.

4. A tanning wand as recited in claim 3 that further contains a means for controlling the tanning oil flow through the vertical portion of the T-shaped passage in the tube.

5. A tanning wand as recited in claim 4 wherein the means for controlling the tanning oil flow through the vertical portion of the T-shaped passage the tube is a stop cock.

6. A tanning wand as recited in claim 5 that further comprises a guard that snaps on the housing over the roller between the end walls for that the guard will protect the roller from dirt, sand and the like.

* * * * *